United States Patent [19]

Kidman

[11] Patent Number: 4,858,840

[45] Date of Patent: Aug. 22, 1989

[54] DISPENSING HANGER FOR ROLLS OF SERIALLY CONNECTED SHEETS

[76] Inventor: L. La Vere Kidman, 1050 E. 800 North, No. 16, Spanish Fork, Utah 84660

[21] Appl. No.: 179,224

[22] Filed: Apr. 8, 1988

[51] Int. Cl.[4] ..... B65H 19/00

[52] U.S. Cl. ..... 242/55.2; D6/522; D6/523

[58] Field of Search ..... 242/55.2, 124.5, 141, 242/134, 130; D6/518, 522, 523

[56] References Cited

U.S. PATENT DOCUMENTS

| | | | |
|---|---|---|---|
| 316,228 | 4/1885 | Blackman | 242/55.2 |
| 1,398,646 | 11/1921 | Murray | 242/55.2 |
| 1,778,282 | 10/1930 | Stewart | 242/55.2 |
| 1,897,266 | 2/1933 | Geoch et al. | 242/55.2 |
| 2,153,840 | 4/1939 | Margolith | 45/28 |
| 2,205,196 | 6/1940 | Hope | 242/55.2 |
| 2,467,825 | 4/1949 | Hall | 242/55.2 |
| 2,514,778 | 7/1950 | Margo | 242/55.2 |
| 2,746,798 | 5/1956 | Wardell, Jr. | 299/96 |

FOREIGN PATENT DOCUMENTS

| | | | |
|---|---|---|---|
| 461401 | 12/1913 | France | 242/55.2 |
| 303277 | 1/1929 | United Kingdom | 242/55.2 |

*Primary Examiner*—David Werner

*Attorney, Agent, or Firm*—Mallinckrodt & Mallinckrodt

[57] ABSTRACT

A dispensing hanger for a roll of paper towels, toilet paper, or the like has a pair of arms with lower ends formed as widely open hooks that are substantially similarly widely based as cradles for receiving upper radial portions of the opposite ends of such a roll and with upper ends formed as eyes pivotally attached to one or to a pair of suspension eyes.

11 Claims, 2 Drawing Sheets

DISPENSING HANGER FOR ROLLS OF SERIALLY CONNECTED SHEETS

BACKGROUND OF THE INVENTION

1. Field

The invention is in the field of dispensing holders for rolls of elongate strips of serially related, tear-off sheets of material, such as paper in the form of paper towels, toilet paper, or the like.

2. State of the Art

Paper towels and toilet paper are customarily produced and sold in rolls comprising transversely scored, elongate strips of paper wound on disposable, hollow, cylindrical, heavy paper or cardboard tubes that are adapted for mounting in holders fastened to walls or other supports to enable convenient dispensing of one or more of the serially related sheets from the so-held rolls by tearing along the score lines between the sheets.

A variety of types of roll holders are commercially available or have been proposed by issued patents. These either include wood, metal, or plastic rollers rotatably mounted between holding arms of one kind or another for receiving and holding the rolls of serially-connected sheets to be dispensed, or roll-mounting devices at the ends of holding arms for fitting into the open ends of such rolls in a manner permitting the received rolls to rotate as sheets of the rolled paper strip are pulled and torn off by users.

SUMMARY OF THE INVENTION

A principal purpose in the making of the invention was to provide a holder for rolls of paper towels, toilet paper, or the like that is extremely simple and economical in construction, reliable in securing received rolls against being pulled free from or dropping out of the holder, and that can be made for either permanent or temporary installation.

The principal features of the invention enabling achievement of the forgoing purpose is the provision of a pair of arms, each having its lower end formed as a widely open and substantially correspondingly widely based hook for fitting into the open end of a roll of sheets to be dispensed and having the upper end formed as an eye pivotally received by a suspension device. The suspension device may be adapted for permanent fastening to a support, as by screwing thereinto, or may be adapted for temporary attachment to a support, as by means of an inverted hook formation to be placed, for example, over a limb of a tree or bush during a camping trip.

THE DRAWING

The best mode presently contemplated for carrying out the invention is shown in the accompanying drawings in which;

FIG. 1 is a view in front elevation of one embodiment of roll hanger of the invention holding a roll of toilet paper shown outlined in vertical axial section;

FIG. 2, a view corresponding to that of FIG. 1 but of a somewhat different embodiment of the roll hanger of the invention holding a roll of paper towels, this view being drawn to a considerably smaller scale and showing the roll in front elevation;

FIG. 3, a side elevation taken from the right in FIG. 2;

FIG. 4, a view corresponding to that of FIG. 2 but of a still different embodiment;

FIG. 5, a view corresponding to those of FIGS. 2 and 4 but again of a different embodiment; and FIG. 6, a view corresponding to that of FIG. 3 but showing the embodiment of FIG. 5.

DETAILED DESCRIPTION OF THE ILLUSTRATED EMBODIMENTS

Figure 1:
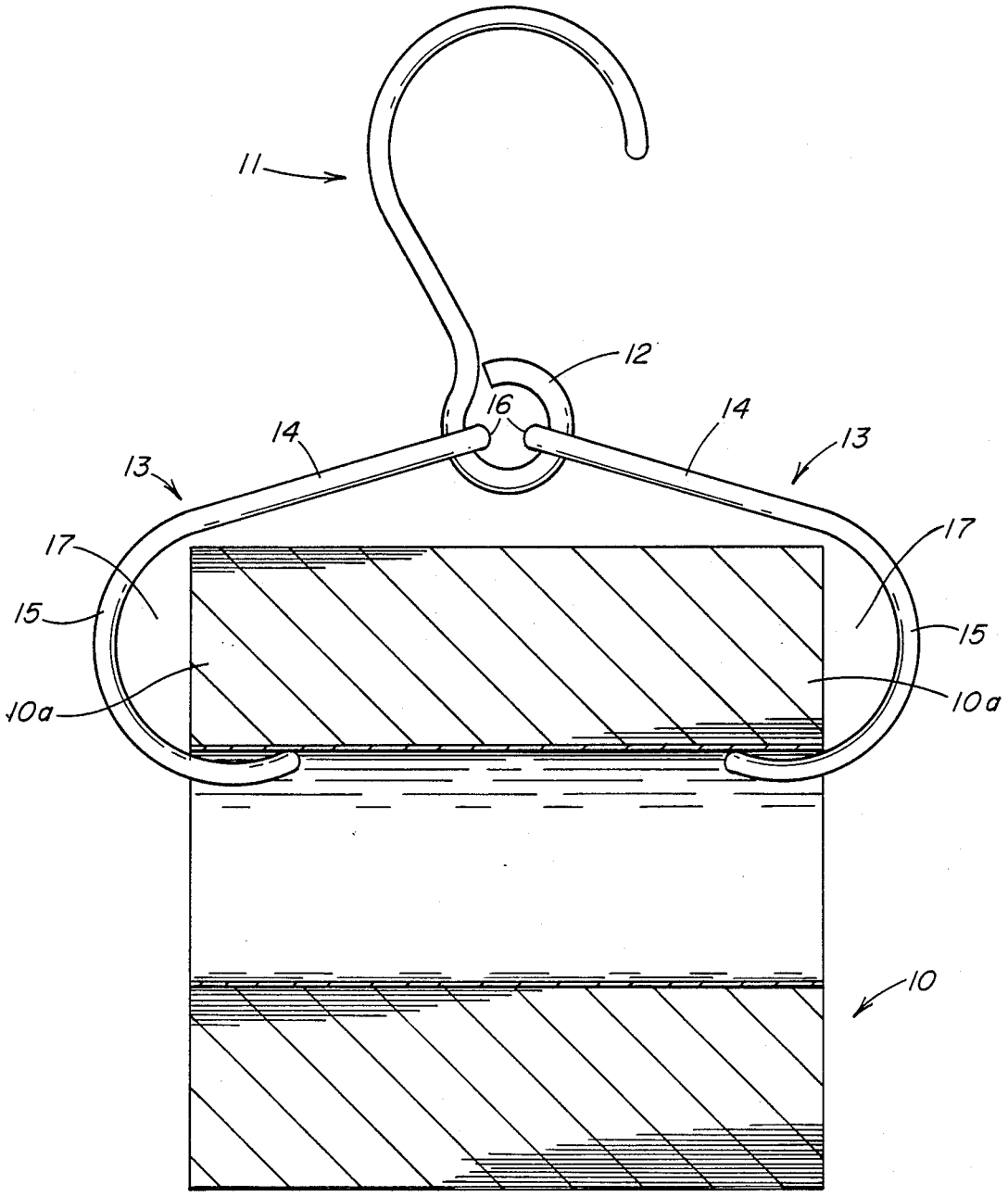

In the embodiment of FIG. 1, the hanger of the invention is made especially for use when camping or otherwise requiring temporary availability of a utility roll of paper. It is shown as a holder for a roll of tolet paper 10 and comprises suspension means in the form of a single suspension device formed as an inverted hook member 11 similar to that of a usual coat hanger for engaging a horizontally extending support, such as the branch of a tree, and having an eye member 12 formed at its lower end. The hanger may be bent to shape from the type of steel wire normal to ordinary wire-formed coat hangers or may be made of other suitable material.

Articulatively secured for at least up and down pivotal movement relative to the suspension device 11, is a pair of roll-supporting arms 13, respectively, each having an elongate shank member 14, a widely open roll-engaging hook member 15 at its lower end, and an eye 16 at its upper end interengaged with the eye member 12 of suspension device 11. As can be seen, widely open hook member 15 is substantially correspondingly widely based to provide a cradle 17 for securely receiving a radial upper portion 10*a* of the end of the roll 10.

Figure 2:
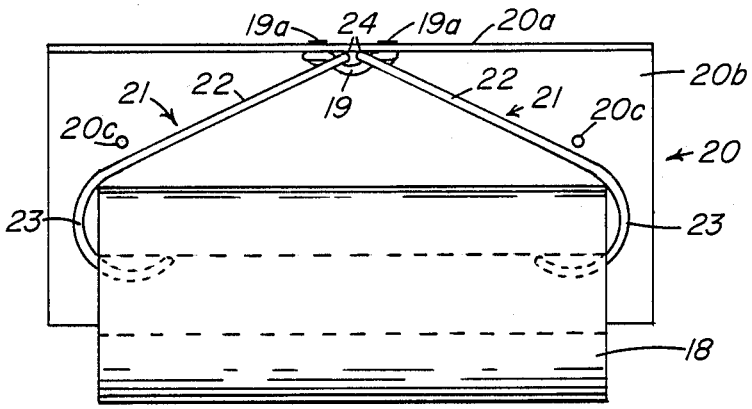
Figure 3:
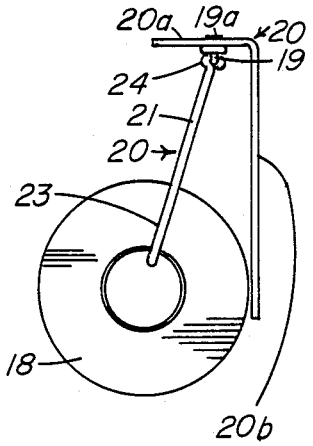

FIGS. 2 and 3 show an embodiment of the invention adapted for holding a roll of paper towels 18. In this embodiment, an eye member 19 is secured by rivets 19*a* to a horizontal portion 20*a* of mounting bracket 20. Mounting bracket 20 also includes a vertical portion 20*b*, which may easily be mounted on a vertical wall (not shown) by screws passing through mounting holes 20*c*. Roll supporting arms 21 have elongate shank members 22 and widely open, roll-engaging, hook members 23, and are substantially universally pivotally secured to eye member 19 by eye members 24 formed at the upper ends of roll-supporting arms 21. In this embodiment, shank members 22 of arms 21 are longer than shank members 14 of the embodiment of FIG. 1 so that the longer roll of paper towels is accommodated in the hook portions 23 similarly to the shorter toilet paper roll shown in FIG. 1. If the bottom of a horizontal support, such as the bottom of a cabinet, is available, the vertical portion of bracket 20 may be eliminated, leaving only the horizontal portion 20a which could be mounted by screws or other appropriate fasteners to the bottom of such horizontal surface.

Figure 4:
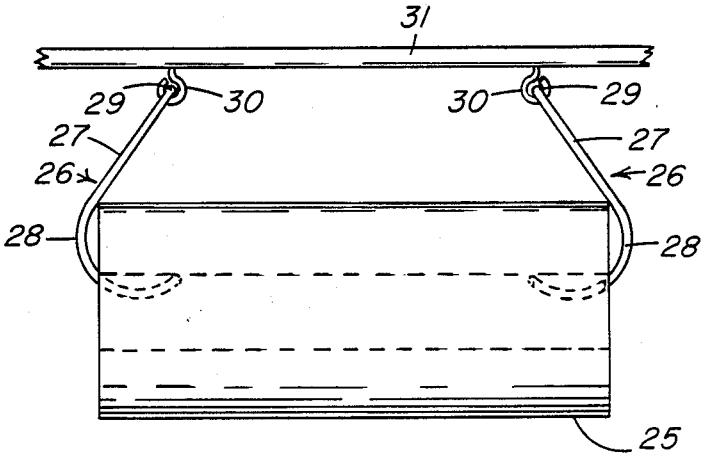

The embodiment of FIG. 4, also a holder for a roll of paper towels, here 25, has roll-supporting arms 26 with short shanks 27, hook members 28, and eye members 29 that are essentially the same as the shanks 14, hook members 15, and eye members 16 of the arms 13 of the embodiment of FIG. 1. The reason that these arms 26 with their relatively short shanks can be used for receiving and supporting elongate rolls of paper towels is that the suspension means is in the form of two separate suspension devices, i.e. ordinary screw eyes 30 for screwing into the underside of a horizontal support 31 in mutually spaced relationship. The spacing should not be greater than about eighty percent of the length of the roll and preferably somewhat less to assure stability and satisfactory dispensing. The greater the shank length, the less should be the spacing between the eyes 30.

Figure 5:
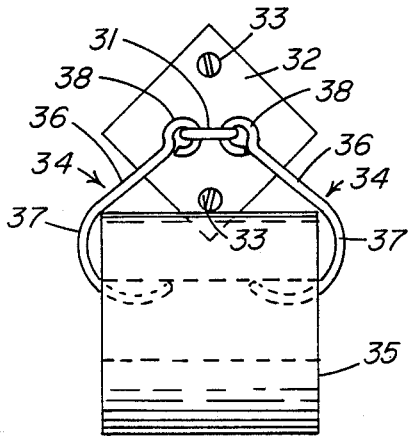
Figure 6:
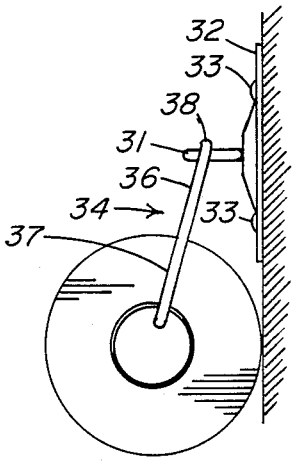

The embodiment of FIGS. 5 and 6 again utilizes a single eye 31 as a roll suspension device. It projects outwardly from an installation plate 32, which may be attached to a wall or other support by screws 33 and which, together with plate 32, provides roll suspension means. As shown, a pair of arms 34 receive and support a roll of toilet paper 35. Each arm is similar to an arm 13, 21, or 26 in that each is similarly formed with a shank member 36, a hook member 37, and an eye member 38.

Other embodiments may be made, for example, of flat strip or of rod stock with the eye member of each arm of the pair provided by a hole for receiving a pivot pin, the eye of the suspension device being similarly provided. Although such a pivot pin type of suspension will not provide for substantially universal pivotal movement, as do the foregoing embodiments of the invention, the provision for solely up and down pivotal movement will be satisfactory for many instances of use.

It has been found that as long as the roll-supporting arms of the invention are pivotally mounted inwardly of the ends of the roll sufficiently so that the shank portion of the arms angle outwardly from their mounting points when a roll is mounted in the widely open hook portions of the arms, gravity acting on the arms will securely maintain the hooks in the ends of the roll and the roll cannot fall out of the holder during use. Also, it has been found that while the contact of the roll-supporting arms with the inside of the roll or end portions of the roll does not produce enough friction against the roll to interfere with the dispensing of the rolled material, enough friction is generally produced to stop the roll from unwinding material on its own, even when the rolled material is jerked to separate unrolled material from the still rolled material.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A dispensing hanger for utility rolls of serially connected, tear-off sheets of paper or the like, comprising a pair of arms, each of which includes an elongate shank member having its lower end formed as a widely open and substantially correspondingly widely based hook member for fitting into the open end of the roll to be received and dispensed, with the radial upper portion of an end of such roll received within the cradle of said hook, the upper end of said shank being formed as an eye member; and suspension means having eye means pivotally attached to the eye members of said arms, said suspension means being located inwardly of the ends of the roll to be received so that the upper ends of said shank members are attached to the suspension means inwardly of the ends of the roll to be received a sufficient distance so that said shank members extend at an angle outwardly from their respective points of attachment toward the respective ends of the roll to be received whereby gravity acting on the respective arms will maintain the hook member in the ends of the roll to be received during use.

2. A hanger according to claim 1, wherein each arm is bent to shape from a length of material having shape-holding rigidity, and the eye member of each arm is pivotally interengaged with the eye means of the suspension means to provide substantially universal pivotal movement for said arms.

3. A hanger according to claim 2, wherein the suspension means comprises a single suspension device provided with a single eye, and the eye members of the pair of arms are both interengaged with said single eye of the suspension device.

4. A hanger according to claim 3, wherein the suspension device is of inverted hook formation for temporary engagement with a horizontally extending support.

5. A hanger according to claim 2, wherein the suspension means comprises a pair of suspension devices each provided with an eye, and the eye members of the pair of arms are interengaged with the eyes, respectively, of the pair of suspension devices.

6. A hanger according to claim 5, wherein each suspension device of the pair of suspension devices is a screw eye.

7. A hanger according to claim 1, wherein the suspension means comprises a single suspension device provided with a single eye, and the eye members of the pair of arms are both interengaged with said single eye of the suspension device.

8. A hanger according to claim 7, wherein the suspension device is of inverted hook formation for temporary engagement with a horizontally extending support.

9. A hanger according to claim 1, wherein the suspension means comprises a pair of suspension devices each provided with an eye, and the eye members of the pair of arms are interengaged with the eyes, respectively, of the pair of suspension devices.

10. A hanger according to claim 1, wherein the suspension means attach the respective eye member at substantially the center of the length of the roll to be received.

11. A hanger according to claim 1, wherein the suspension means attach the respective eye members at a distance apart not greater than eighty percent of the length of the roll to be received.

* * * * *